US011103004B2

(12) United States Patent
Madani

(10) Patent No.: US 11,103,004 B2
(45) Date of Patent: Aug. 31, 2021

(54) INTERLOCKING HOOKAH SUPPORT DEVICE AND SYSTEM

(71) Applicant: Star Hookah, Inc., Hollywood, CA (US)

(72) Inventor: Nathan Madani, Los Angeles, CA (US)

(73) Assignee: Star Hookah, Inc., Hollywood, CA (US)

( * ) Notice: Subject to any disclaimer, the term of this patent is extended or adjusted under 35 U.S.C. 154(b) by 381 days.

(21) Appl. No.: 16/135,221

(22) Filed: Sep. 19, 2018

(65) Prior Publication Data

US 2019/0082733 A1 Mar. 21, 2019

Related U.S. Application Data

(60) Provisional application No. 62/560,575, filed on Sep. 19, 2017.

(51) Int. Cl.
*A24F 1/30* (2006.01)
*A24F 9/14* (2006.01)

(52) U.S. Cl.
CPC . *A24F 9/14* (2013.01); *A24F 1/30* (2013.01)

(58) Field of Classification Search
None
See application file for complete search history.

(56) References Cited

U.S. PATENT DOCUMENTS

| | | | |
|---|---|---|---|
| 2,565,939 | A | 4/1947 | Wriston |
| 4,578,910 | A | 4/1986 | Germeroth |
| 5,738,116 | A | 4/1998 | Truelove |
| 6,684,592 | B2 | 2/2004 | Martin |
| 2007/0215165 | A1 | 9/2007 | Mazakis |
| 2011/0179728 | A1 | 7/2011 | Cerny |
| 2013/0330680 | A1 | 12/2013 | Bavar |

OTHER PUBLICATIONS

International Search Report for PCT/US2018/51663 dated Jan. 16, 2019.

*Primary Examiner* — Michael H. Wilson
*Assistant Examiner* — Katherine A Will
(74) *Attorney, Agent, or Firm* — The Myers Law Group

(57) ABSTRACT

A hookah support device, comprising a support base, a removable interlocking panel configured to removably attach to the support base, further comprised of a top panel and a bottom panel, a semicircular groove situated on a receiving end of the support base, a semicircular groove situated on a proximal end of the top panel of the interlocking panel, wherein the support base comprises a first and a second parallelly situated interlocking grooves configured to receive therein a first and a second parallelly situated interlocking tongue pieces of the interlocking panel; and wherein interlocking panel is slidably removable from the support base.

11 Claims, 9 Drawing Sheets

INTERLOCKING HOOKAH SUPPORT DEVICE AND SYSTEM

PRIORITY CLAIM

This application claims the priority date of provisional application No. 62/560,575 filed on Sep. 19, 2017, which is herein incorporated by reference in its entirety.

BACKGROUND

Hookah tables and racks are generally used for when a person, or a group of people, are vaporizing and smoking flavored tobacco using a hookah. Hookahs are typically made of glass, and may have certain metal and plastic components, among other materials, and have various designs and ornamentations. Further, hookahs are heated when in use, and the glass or clay bowl (where the tobacco is stored to smoke) of a hookah is capable of burning a user upon touch. Additionally, the bowl that holds the charcoal is another heating point on a hookah that can cause substantial burns. However, such tables and racks do not provide a sufficient level of stability for a hookah when in use as the hookahs can wobble, tilt, and turn over, potentially causing an accident such as burns from the hookah and/or coal or cuts from broken glass or metals attached to the hookah.

As such there is a need for a hookah table support system that provides for the enhanced stability and placement for various sizes and styles of hookahs in both residential and commercial settings. Thus, a hookah table support system that can be implemented in various settings and configurations while withstanding the heat of a hookah and without tilting, wobbling, or other instability issues is needed.

SUMMARY

A hookah support device, comprising a support base, a removable interlocking panel configured to removably attach to the support base, further comprised of a top panel and a bottom panel, a semicircular groove situated on a receiving end of the support base, a semicircular groove situated on a proximal end of the top panel of the interlocking panel, wherein the support base comprises a first and a second parallelly situated interlocking grooves configured to receive therein a first and a second parallelly situated interlocking tongue pieces of the interlocking panel; and wherein interlocking panel is slidably removable from the support base.

A hookah support system, comprising a support base, a plurality of removable interlocking panels configured to removably attach to the support base, wherein each interlocking panel is further comprised of a top panel and a bottom panel, a plurality of semicircular grooves situated on a plurality of receiving ends of the support base, a semicircular groove situated on each of the plurality of interlocking panels at a proximal end of the top panel of each interlocking panel, wherein the support base comprises a plurality of sets of parallelly situated interlocking grooves configured to receive therein a plurality of sets of parallelly situated interlocking tongue pieces of each interlocking panel; and wherein the interlocking panels are slidably removable from the support base.

A method of supporting a hookah device, comprising the steps of configuring a support panel with a first and a second parallelly situated interlocking grooves, and with a semicircular groove situated on a receiving end of the support base, configuring an interlocking panel with a first and a second parallelly situated interlocking tongue pieces that are further configured to removably slide into the first and second interlocking grooves of the support panel, wherein the interlocking panel is further configured with a top panel and a bottom panel; and configuring the interlocking panel with a semicircular groove situated on a proximal end of the top panel.

Figure 1:
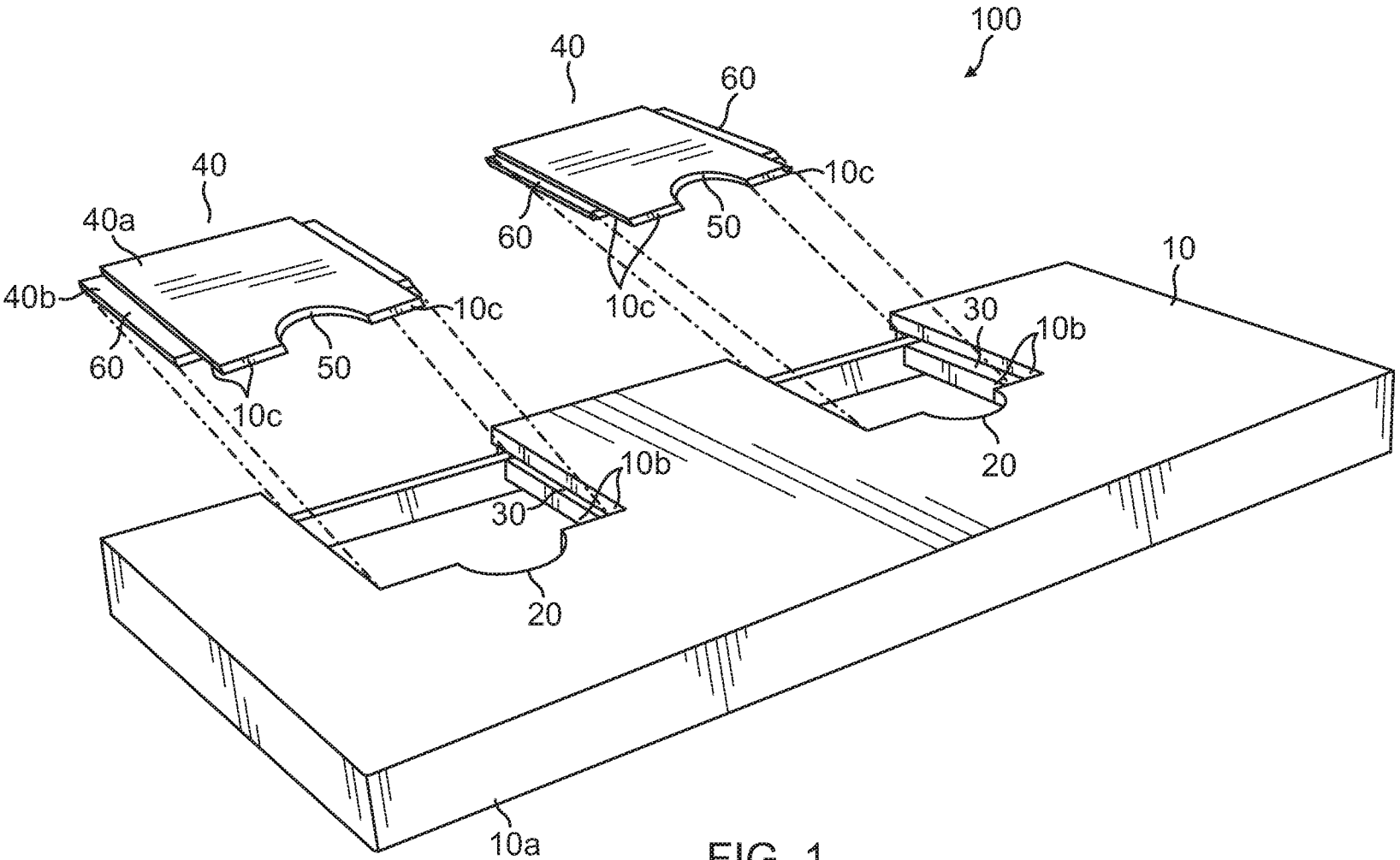
FIG. 1 is an exploded perspective view of the present interlocking hookah support device and system.

| LISTING OF REFERENCE NUMERALS of EMBODIMENTS | |
|---|---|
| Support panel | 10 |
| Support panel rim | 10a |
| Inner support rim | 10b |
| Inner support rim | 10c |
| Inner semicircle groove | 20 |
| Locking groove | 30 |
| Interlocking panel | 40 |
| Top Panel | 40a |
| Bottom Panel | 40b |
| Outer semicircle groove | 50 |
| Locking tongue panel | 60 |
| Support panel base | 70 |
| Hole | 80 |
| Hole | 81 |
| Ice Cooler Container | 90 |
| Interlocking Hookah Support Device and System | 100 |

DETAILED DESCRIPTION

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Figure 2:
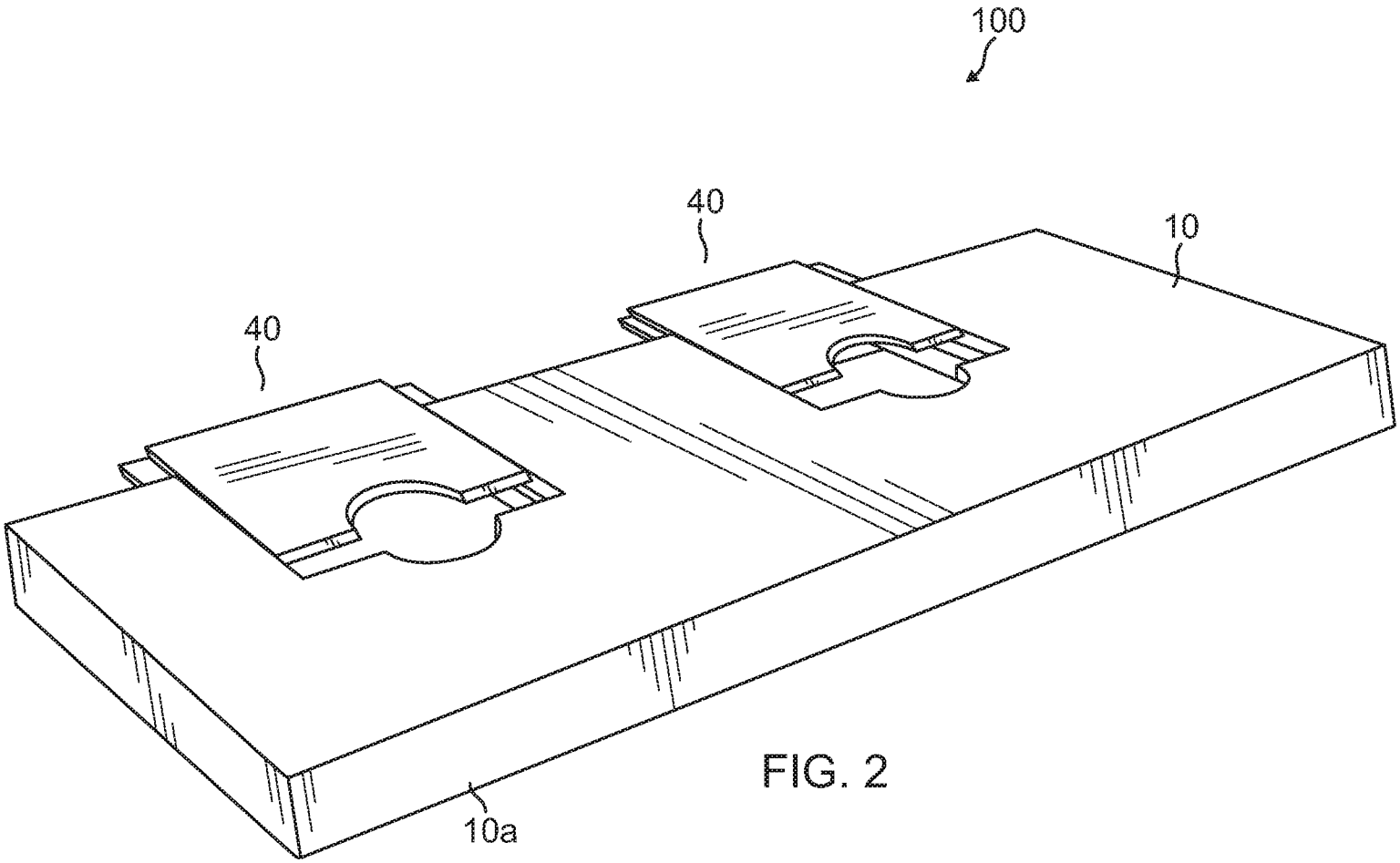
FIG. 2 is a perspective view of the present interlocking hookah support device and system showing a plurality of interlocking panels in intermediate closed positions.

FIG. 1 is an exploded perspective view of the present interlocking hookah support device and system (100). Support panel (10) may be rectangular in shape, and further comprised of a panel rim (10*a*). In an exemplary embodiment, panel rim (10*a*) may be at least four inches in height and one inch in thickness with the length and width dimensions varying in scope depending on the overall dimensions desirable by a user. Support panel (10) may be further comprised of a plurality of locking grooves (30), inner support rim (10*b*) (further depicted in FIG. 5), and an inner semicircle groove (20). Interlocking panel (40) may further comprised of a top panel (40*a*) and a bottom panel (40*b*). Top panel (40*a*) may be generally square shaped in nature, and further comprised of an outer semicircle groove (50), locking tongue panel (60), and inner support rim (10*c*), all of which are integrated together into one piece. Bottom panel (40*b*) may be rectangular in shape, and may have a width greater than top panel (40*a*). Locking tongue panel (60) may be generally rectangular in shape and comprises one or more locking tongue pieces, which are configured to fit into one or more locking grooves (30) of support panel (10) by sliding therein until inner support rim (10*c*) rests against inner support rim (10*b*) of support panel (10). Locking grooves (30) may be configured in dimension and shape to mate one or more locking tongues (60) of interlocking panel (40) as shown in FIG. 2 where interlocking panels (40) are inserted into support panel (10) via locking grooves (30). Interlocking panels (40) may be removable in nature, and one or both of interlocking panels (40) and locking grooves (30) may be configured with click in mechanisms to further stabilize the placement of interlocking panels (40).

Support panel (10) may be comprised of Hi-Mac® material in an exemplary embodiment of the present interlocking hookah support device, or an acrylic solid surface, plastic laminate, granite, or synthetic stone and tile however, other materials may be utilized without deviating from the scope of the present invention. Generally, a dense or heavier material may be used in order to provide sufficient support for the hookah (which can vary in size and weight) as well as withstand the heat from a hookah. Interlocking hookah support device and system (100) may be configured to hold two interlocking panels (40) such as is shown in FIGS. 1-5, but may also be configured for a single interlocking panel (40), or for more than two interlocking panels (40) depending on whether the interlocking hookah support device and system (100) is used for residential or commercial purposes. In a residential setting, interlocking hookah support device and system (100) may comprise of one setting for a hookah device, whereas in a commercial setting, it may comprise two or more settings for hookah devices. Support panel (10) is configured to serve as a retrofit piece for an existing countertop (depending on spacing requirements below where support panel (10) is to be positioned) or replacement for a countertop, table, or other surface types, and may be used in conjunction with support panel base (70) or other base containers (as discussed below). Interlocking hookah support device and system (100) may also be configured to hold the weight of various sizes and weights of hookahs, along with any accessory items typically used with hookahs, such as fruit bowls and other decorative arrangements.

Figure 3:
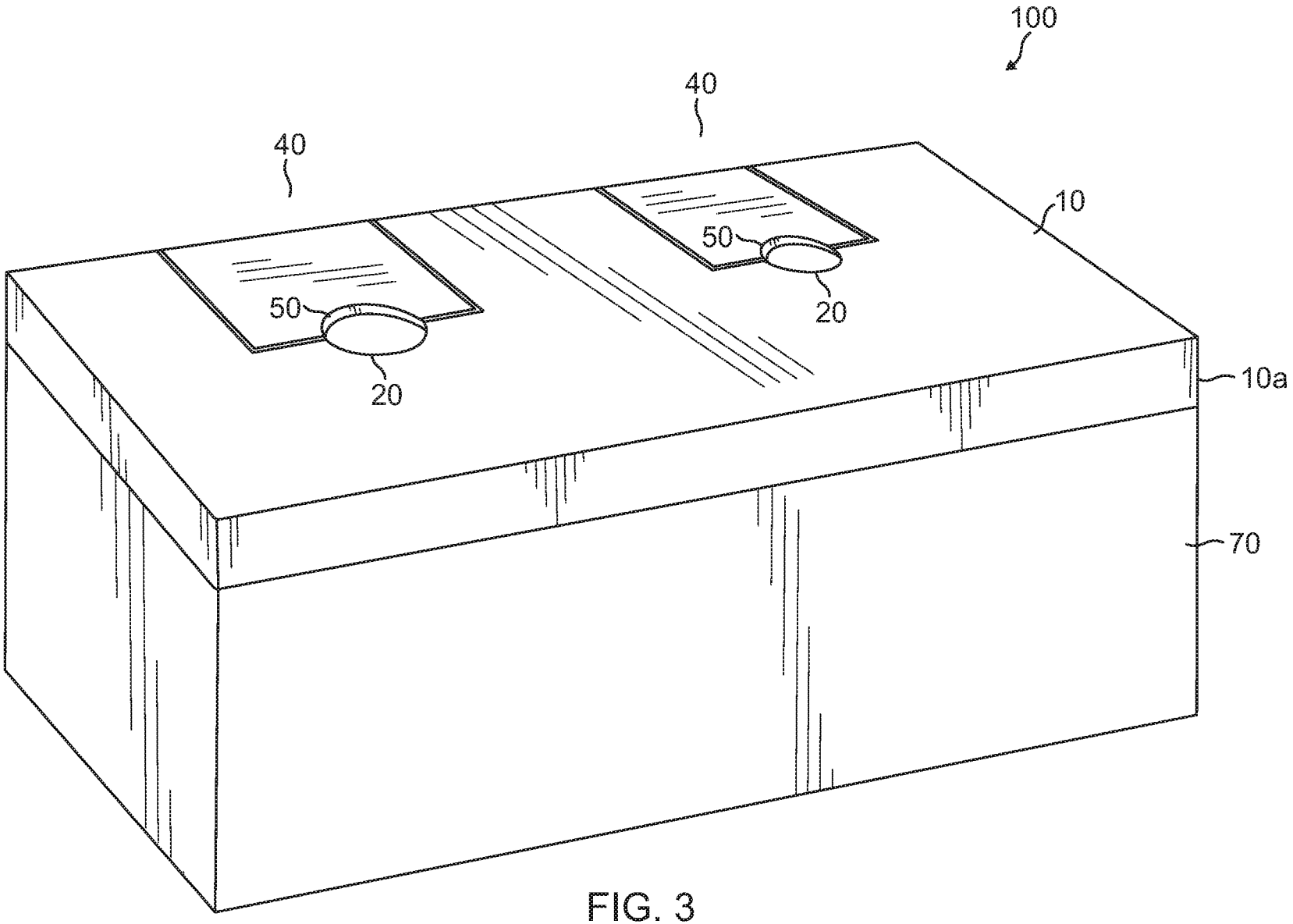
FIG. 3 is a perspective view of the present interlocking hookah support device and system showing a plurality of interlocking panels in closed positions.

FIG. 3 illustrates another embodiment of the interlocking hookah support device and system (100), which further comprises a support panel base (70). Support panel base (70) may be comprised of the same material as support panel (10), or may be comprised of wood or other sturdy materials adequate to secure and hold support panel (10) and one or more hookahs. Support panel base (70) may vary in dimension, particularly in depth, to accommodate different hookah sizes, and in an exemplary embodiment may be at least 4" to 8" inches in depth. Further, support panel base (70) may be further adjustable by layering an inner base portion of support panel base (70) with paneling under a hookah so as to raise its height within the interlocking hookah support device and system (100). Depending on arrangements used and ornamental preferences, base (70) may be translucent or clear in nature to allow viewing of the base of a hookah. Support panel rim (10*a*) may be attached to support panel base (70) via a strong adhesive, brackets, nails, welding, or a combination thereof, or may be constructed as one integrated piece.

Figure 4:
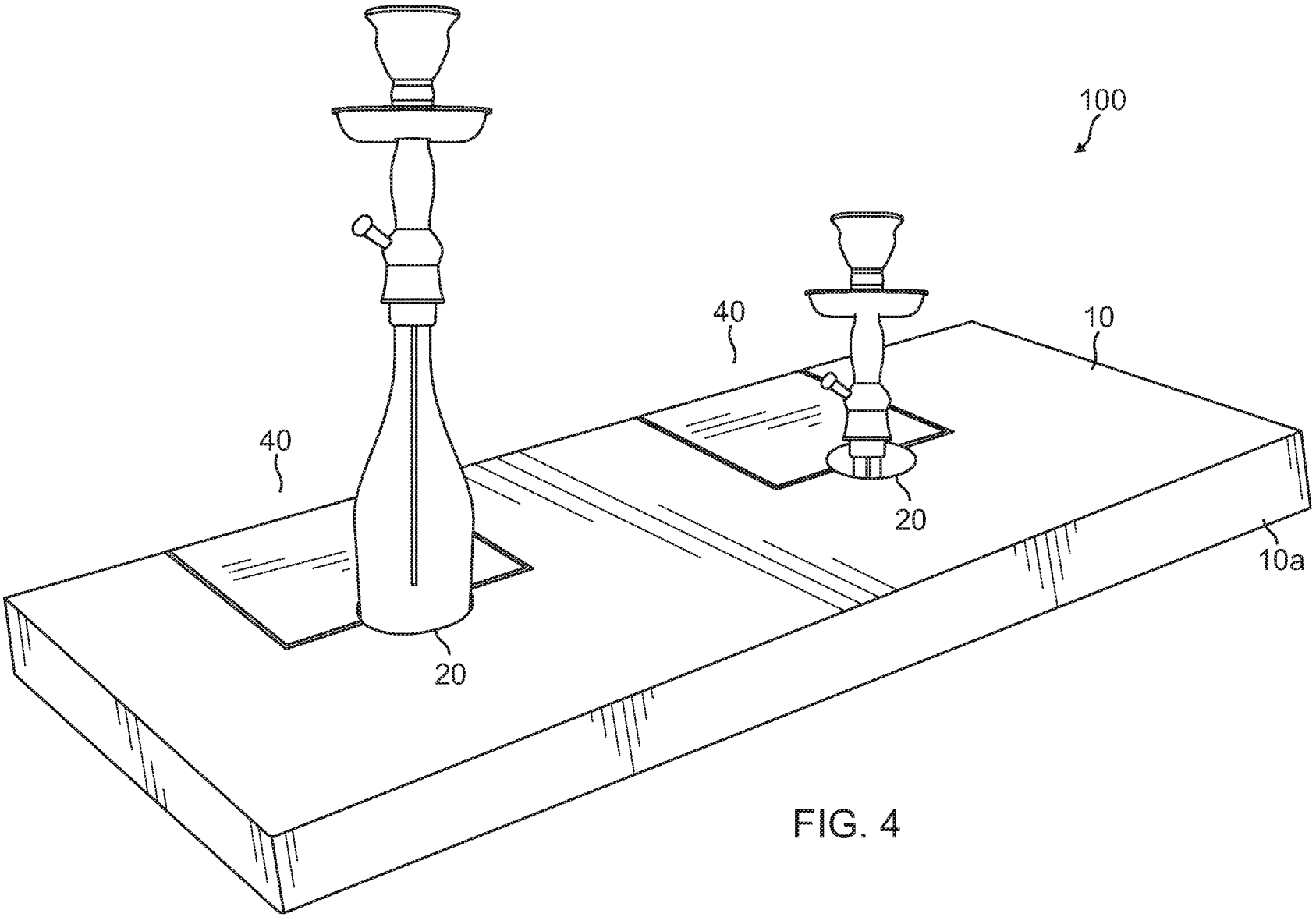
FIG. 4 is a perspective view of the present interlocking hookah support device and system showing a plurality of hookahs configured therein.

FIG. 4 is a perspective view of the present interlocking hookah support device and system (100) showing a plurality of hookahs configured therein. Depending on whether interlocking hookah support device and system (100) is configured with support panel base (70), the base of the hookahs shown may be placed between semicircle channel panel (50) and semicircle groove (20) towards its bottom portion (as shown in FIG. 4), or placed at a lower level within support panel base (70) so that a substantial portion of the hookah base is positioned below support panel (10).

Figure 5:
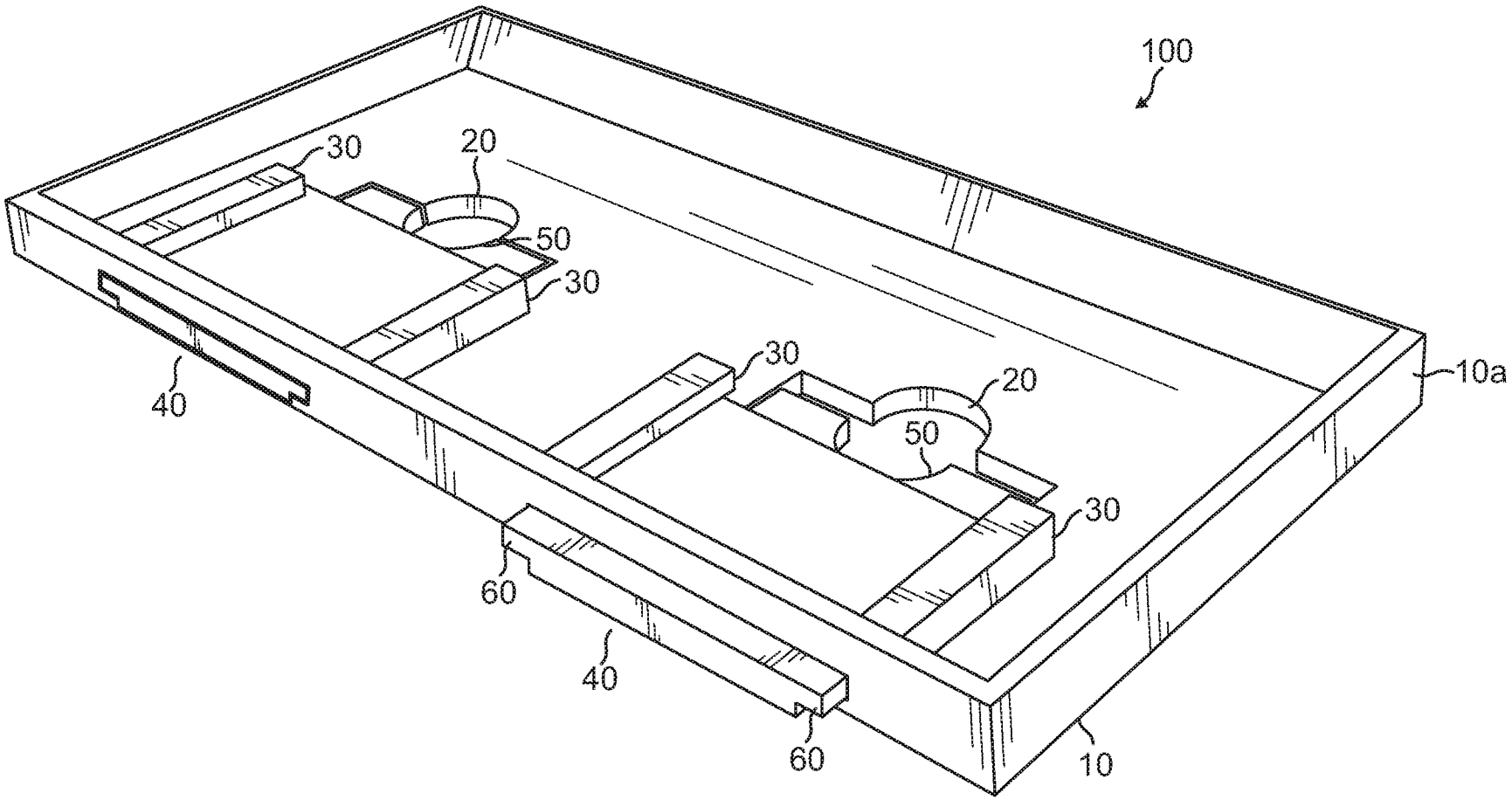
FIG. 5 is a perspective view of the bottom of the present interlocking hookah support device and system.

FIG. 5 is a perspective view of the bottom of the present interlocking hookah support device and system (100). In this view, one of the interlocking panels (40) is shown in a closed position, and the other interlocking panel (40) is shown in a semi-closed position. The interlocking hookah support device and system (100) is configured to hold most sizes of hookahs, but can be adjusted around a base, stem, or other applicable portion of a hookah, by adjusting the position of interlocking panel (40) around the circumference, or other area, of the hookah.

Figure 6:
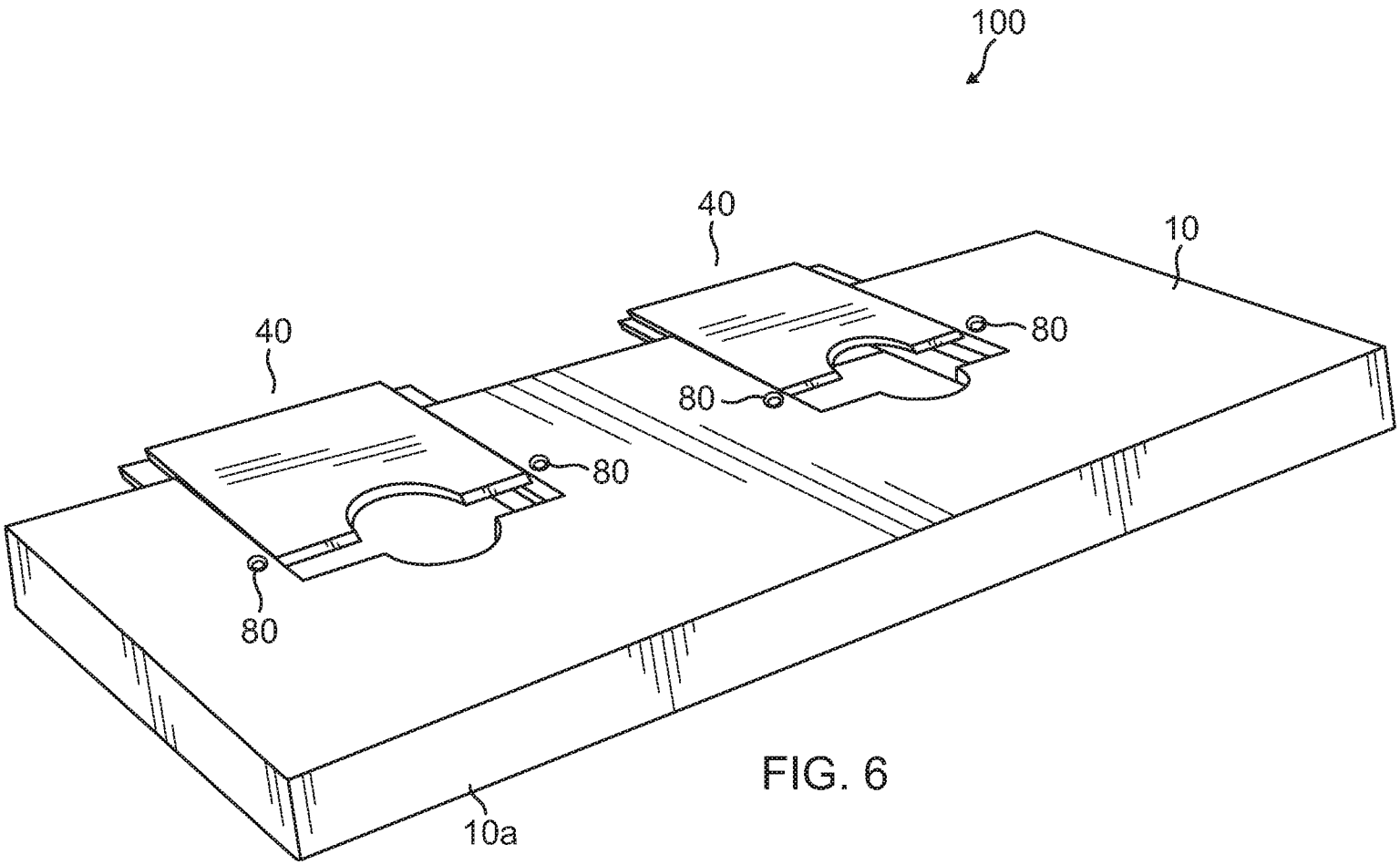
FIG. 6 is a perspective view of the interlocking hookah support device and system showing a securement feature in connection with the interlocking panels in an open, unfastened position.
Figure 7:
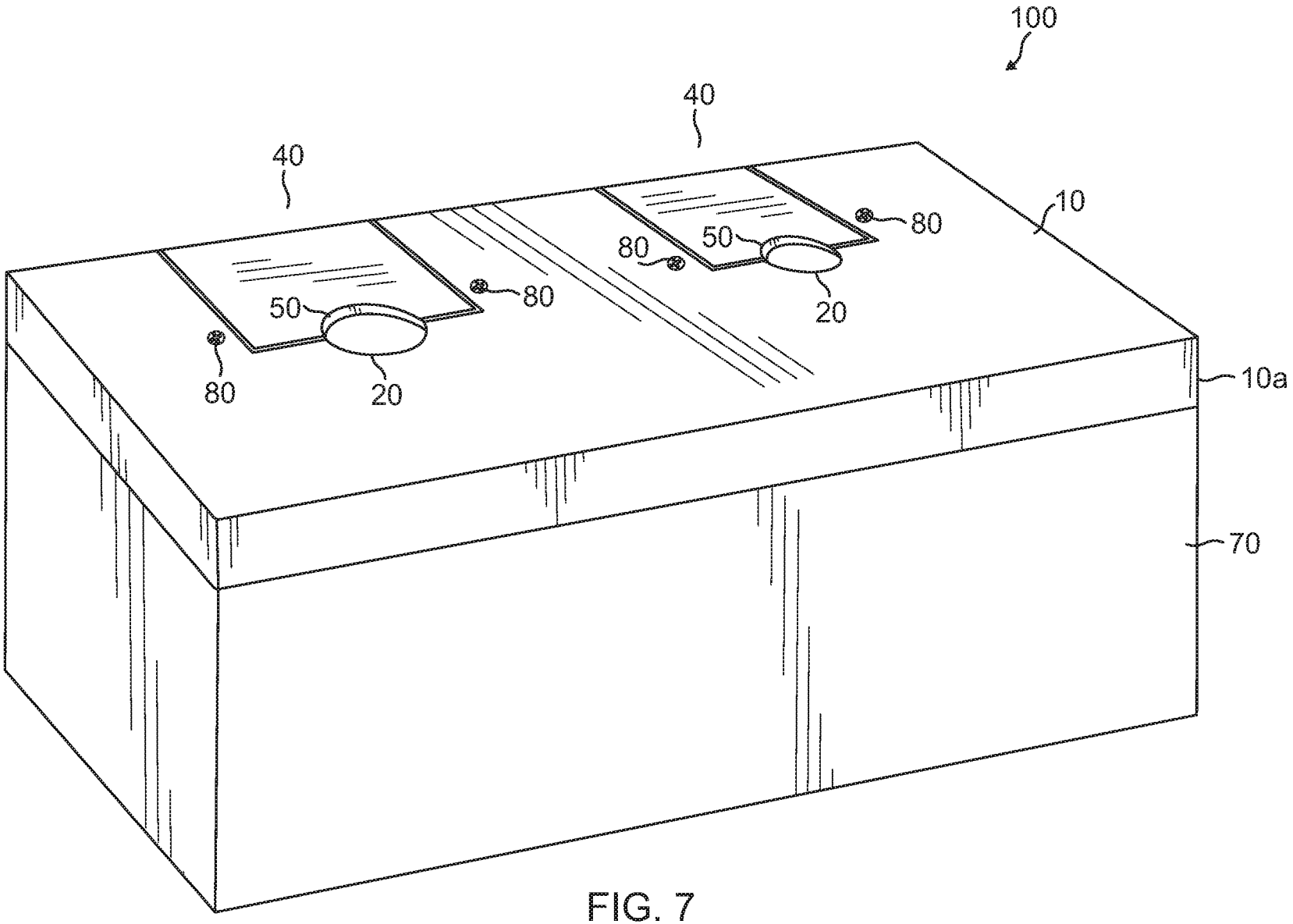
FIG. 7 is a perspective view of the interlocking hookah support device and system showing a securement feature in connection with the interlocking panels in an closed, fastened position.

FIGS. 6 and 7 depict an additional securement feature of interlocking hookah support device and system (100). Support panel (10) may further comprise one or more holes (80), such as threaded holes, and locking tongue panels (40) may further comprise one or more holes (81) (not shown in these views), such as threaded holes. Holes (81) may be vertically parallel in position to holes (80) of support panel (10) so that a screw, or other appropriate fastening mechanism, may be inserted and secured therein. Such securement can be used when utilizing particularly large hookahs within device (100) or to dissuade a user or other third party from manipulating device (100) or the hookah. FIGS. 6 and 7 show interlocking panel (40) in opened positions with a screw device fastened within holes (80 and 81) and in closed positions.

Figure 8:
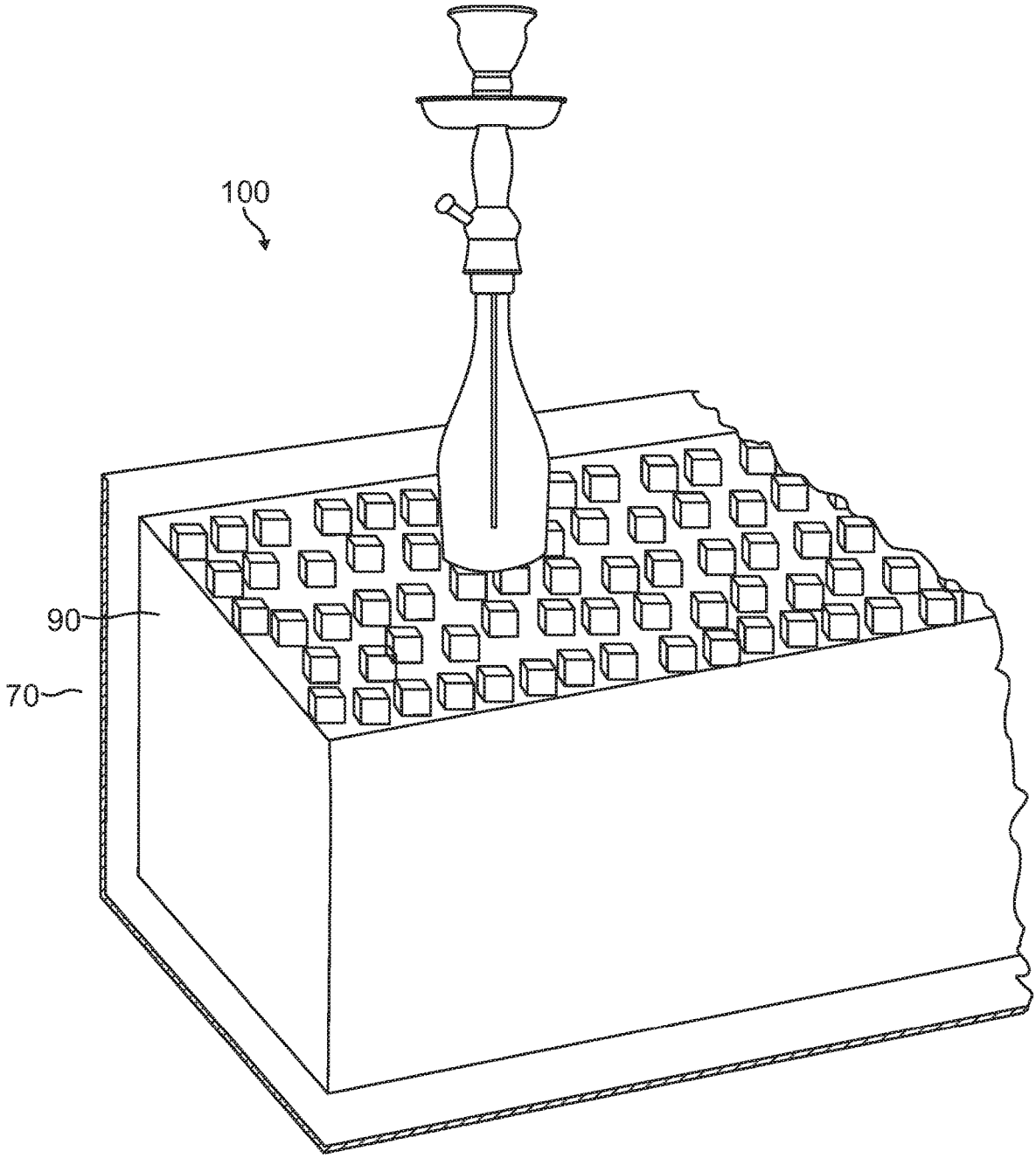
FIG. 8 depicts a cross-sectional view of an ice cooler container integrated within the interlocking hookah support device and system.
Figure 9:
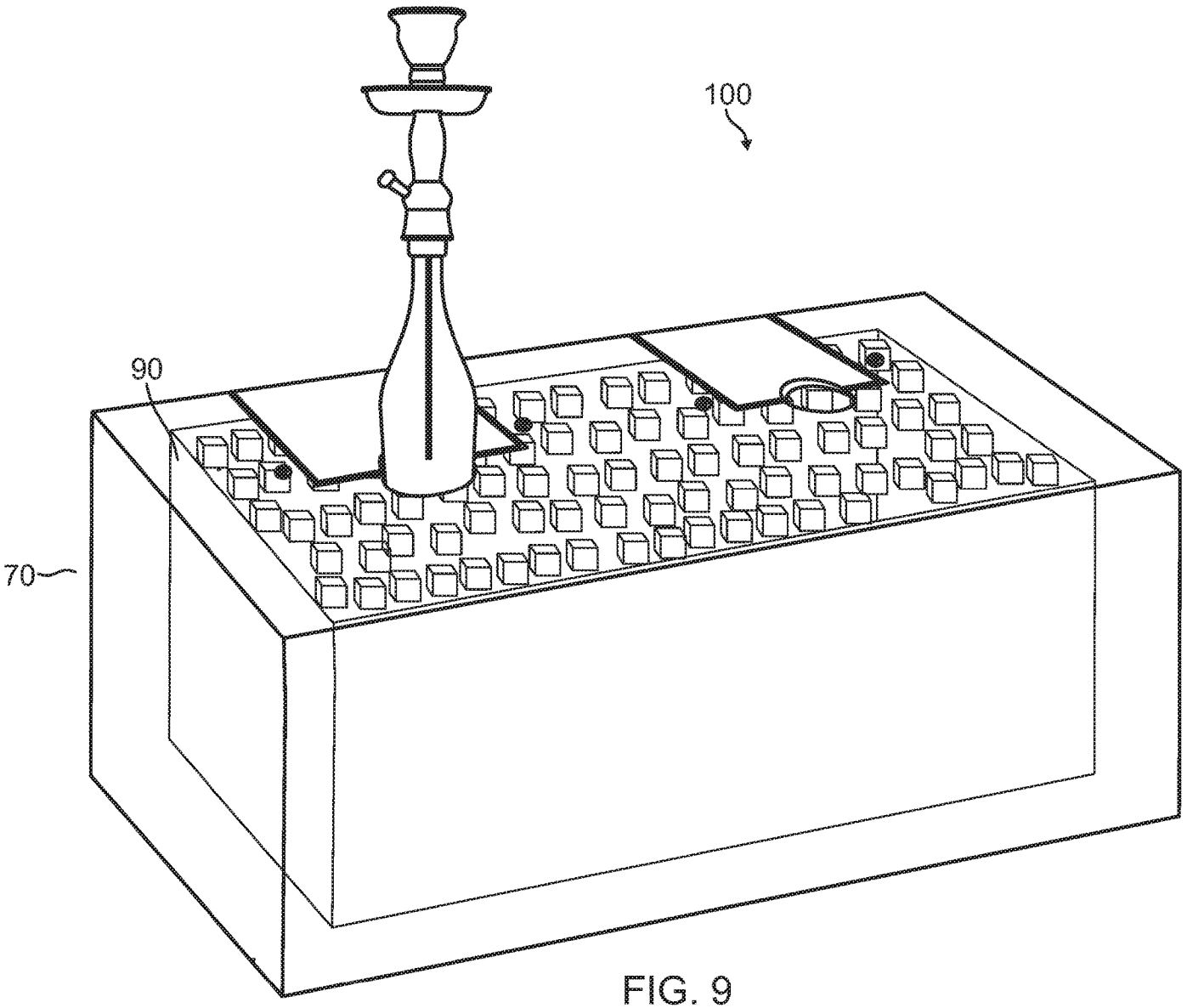
FIG. 9 depicts another cross-sectional view of an ice cooler container integrated within the interlocking hookah support device and system.

FIGS. 8 and 9 depict another embodiment of interlocking hookah support device and system (100) comprising an integrated ice cooler container (90) allowing the hookah(s) to rest upon ice while in use. As explained earlier, support base (70) may be enclosed with waterproof lining material for the purpose of filling the same with ice for the hookah to rest upon. Furthermore, support base (70) may be fitted with a waterproof/insulated material or container, such as that used in connection with ice cooler containers and other similar devices, which may enclosed all or part of the internal portion of support base (70). For example, a waterproof/insulated material be retrofitted and integrated as a sub-container within support, base (70), such as that shown in FIGS. 8 and 9. Such integration may be as an attachment to support base (70) and/or support panel (10). Further, fastening mechanisms, such as brackets and clips, may be utilized to keep the ice cooler container (90) in place until removal is necessary to change out the ice within container (90) or for other cleaning and maintenance purposes.

While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. A hookah support device, comprising:

a support base;

a removable interlocking panel configured to removably attach to the support base, further comprised of an integrated top panel and bottom panel staggered in position upon each other;

a semicircular groove situated on a receiving end of the support base;

a semicircular groove situated on a proximal end of the top panel of the interlocking panel;

wherein the support base comprises a first and a second parallelly situated interlocking grooves configured to receive therein a first and a second parallelly situated interlocking tongue pieces of the interlocking panel with the interlocking tongue pieces extending laterally from the bottom panel and with a greater width than the top panel; and wherein the interlocking panel is slidably removable from the support base.

2. The hookah support device of claim 1, wherein the bottom panel is rectangular in shape and the top panel is square in shape.

3. The hookah support device of claim 1, wherein the semicircular grooves of the support base and the interlocking panel each have a diameter that is equal to each other.

4. The hookah support device of claim 3, wherein when the semicircular groove of the interlocking panel is positioned adjacent to the semicircular groove of the support base, it forms a circular shape.

5. The hookah support device of claim 1, wherein the support base is rectangular in shape.

6. The hookah support device of claim 5, wherein the support base further comprises a support rim situated perpendicular around support base's lengths and widths.

7. The hookah support device of claim 6, wherein the support base is attached atop a support container via the support rim.

8. The hookah support device of claim 7, wherein an internal portion of the support container is enclosed with a waterproof lining.

9. A hookah support system, comprising:

a support base;

a plurality of removable interlocking panels configured to removably attach to the support base, wherein each interlocking panel is further comprised of a top panel and a bottom panel;

a plurality of semicircular grooves situated on a plurality of receiving ends of the support base;

a semicircular groove situated on each of the plurality of interlocking panels at a proximal end of the top panel of each interlocking panel;

wherein the support base comprises a plurality of sets of parallelly situated interlocking grooves configured to receive therein a plurality of sets of parallelly situated interlocking tongue pieces of each interlocking panel; and wherein the interlocking panels are slidably removable from the support base.

10. The hookah support device of claim 9, wherein the bottom panel is rectangular in shape and the top panel is square in shape.

11. A method of supporting a hookah device, comprising the steps of:

configuring a support panel with a first and a second parallelly situated interlocking grooves, and with a semicircular groove situated on a receiving end of a support base;

configuring an interlocking panel with a first and a second parallelly situated interlocking tongue pieces that are further configured to removably slide into the first and second interlocking grooves of the support panel;

wherein the interlocking panel is further configured with an integrated top panel and bottom panel staggered in position upon each other and further wherein the interlocking tongue pieces extend laterally from the bottom panel and with a greater width than the top panel; and configuring the interlocking panel with a semicircular groove situated on a proximal end of the top panel.

* * * * *